US006202461B1

(12) United States Patent
Brinkman

(10) Patent No.: US 6,202,461 B1
(45) Date of Patent: Mar. 20, 2001

(54) TANGENTIAL THREAD ROLLING HEAD

(75) Inventor: Robert J. Brinkman, Roch., NY (US)

(73) Assignee: C. J. Winter Machine Technologies, Inc., Rochester, NY (US)

( * ) Notice: Subject to any disclaimer, the term of this patent is extended or adjusted under 35 U.S.C. 154(b) by 0 days.

(21) Appl. No.: 09/244,542

(22) Filed: Feb. 3, 1999

(51) Int. Cl.[7] ..... B21H 3/04
(52) U.S. Cl. ..... 72/104; 72/108
(58) Field of Search ..... 72/104, 108, 244, 72/407, 452.9; 74/107; 81/90.9, 91.3, 349; 82/54, 58, 100

(56) References Cited

U.S. PATENT DOCUMENTS 3,184,003 * 5/1965 Kershner ..... 74/107
4,426,869 * 1/1984 Farmer et al. ..... 72/108

* cited by examiner

*Primary Examiner*—Lowell A. Larson
(74) *Attorney, Agent, or Firm*—Shlesinger, Fitzsimmons & Shlesinger

(57) ABSTRACT

The attachment includes a generally U-shaped bracket having a pair of roll arms which are pivotally mounted intermediate their ends on the outer ends, respectively, the two arms of the U-shaped bracket. Each roll arm has a thread roll rotatably mounted on its outer end and a roller follower rotatably mounted on its inner end. The bracket is secured on the slide of a screw machine for reciprocation thereby in a direction selectively to engage the thread rolls tangentially with diametrally opposite sides of a rotating workpiece that is to be threaded. The roller followers on the opposite ends of the roll arms are maintained resiliently into rolling engagement with the opposed, inclined surfaces formed on the wedge-shaped forward end of a thread roll adjusting element, which is mounted on the bracket for adjustment by a manually rotatable knob selectively to shift the wedge-shaped forward end thereof in opposite directions thereby to vary the space separating the roller followers, and consequently the thread rolls.

8 Claims, 2 Drawing Sheets

TANGENTIAL THREAD ROLLING HEAD

BACKGROUND OF THE INVENTION

This invention relates to thread roll attachments for screw thread machines and the like, and more particularly to an improved thread rolling head or attachment which carries two thread rolls, and which is substantially easier to set up and adjust than prior such attachments. Even more particularly, this invention is related to an improved such attachment which is particularly suited for use as a tangential thread roll attachment.

A thread rolling attachment somewhat similar to that disclosed herein is disclosed in U.S. Pat. No. 4,617,816, which is owned by the Assignee of this patent application. For example, the above-noted patent discloses an attachment including a pair of arms that are pivotally mounted intermediate their ends on a yoke, so that two thread rolls, which are supported on the arms can be forced radially into rolling engagement with opposite sides of a piece of rotating bar stock in order to form threads on the stock. The arms are actuated by a wedge element which is manipulated by a fluid pressure operated piston. Although such prior art mechanism is suitable for introducing the thread rolls radially into diametrally opposite sides of the rotating bar stock, it has been found to be most desirable to provide a more accurate and easier means of manipulating the wedge element prior to engagement of the thread rollers with the rotating bar stock. Moreover this accuracy is particularly important in mechanisms of the type which utilize tangential engagement of the thread rolls with the bar stock.

Accordingly, it is an object of this invention to provide an improved, rather inexpensive and compact means for manipulating a wedge element of the type that is employed for accurately positioning the threading rolls of a threading roll attachment.

Still another object of this invention is to provide an improved thread rolling head of the type described in which the associated threading roll adjusting mechanism can be easily and readily manipulated manually by an operator to provide very accurate spacing between the threading rolls prior to engagement thereof with the associated workpiece.

A still further object of this invention is to provide an improved thread rolling head which is mounted on means for effecting tangential engagement of the threading rolls with the work that is to be threaded.

Other objects of the invention will be apparent hereinafter from the specification and from the recital of the appended claims, particularly when read in conjunction with the accompanying drawings.

SUMMARY OF THE INVENTION

The thread rolling head includes a generally yoke-shaped bracket having a closed end from which projects a pair of spaced, parallel bracket arms between which extend a pair of spaced, parallel fulcrum or pivot pins Pivotally mounted intermediate their ends on the fulcrum pins are two thread roll supporting arms which project at their forward ends beyond the forward ends of the bracket arms, and at their opposite ends toward the closed end of the bracket. Mounted in registering recesses in the forward ends of the roll supporting arms to rotate in spaced relation about axes that extend generally parallel to the fulcrum pins are two conventional thread rolls. At their opposite ends the thread roll supporting arms have rotatably mounted thereon a pair of roller followers, which are urged by springs into rolling engagement with a pair of inclined, opposed surfaces formed on the forward end of a wedge that projects between the roller followers. The wedge is pivoted at its rear end to a pin which is threadably connected to the forward end of an adjusting screw, the rear end of which is secured to a knurled adjusting knob that is rotatably mounted on the closed end of the bracket.

The bracket is supported on a slide which operates to reciprocate the bracket to and from an operative position selectively to engage the threading rolls tangentially with diametrally opposite sides of the rotating workpiece that is to be threaded. Before advancing the threading rolls into engagement with the work the adjusting knob is rotated accurately to set the desired space separating the threading rolls. Also if necessary the knob can be rotated to adjust the threading rolls even when in their operative positions without having to shut down the associated machine.

THE DRAWINGS

DETAILED DESCRIPTION OF THE PREFERRED EMBODIMENTS

Figure 4:
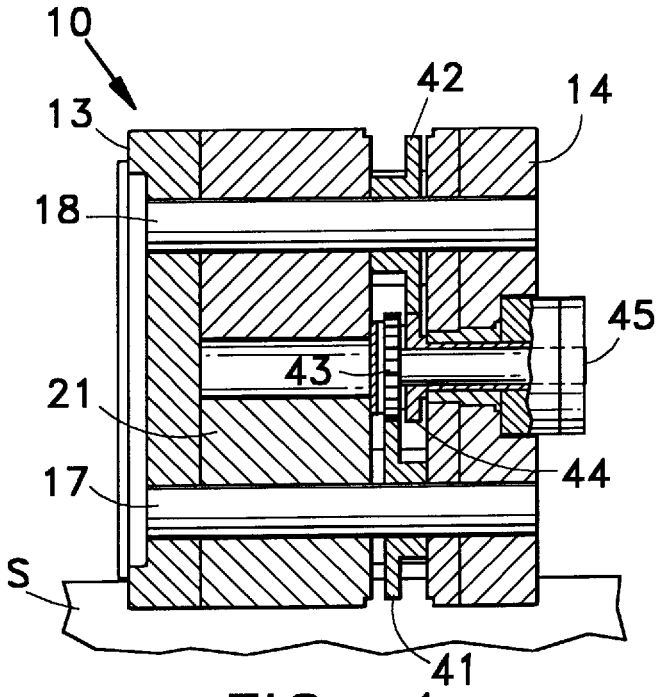
FIG. 4 is a sectional view taken generally along the line 4—4 in FIG. 1 looking in the direction of the arrows.

Referring now to the drawings by numerals of reference, 10 denotes generally a tangential thread rolling head comprising a quick release roll arm yoke or bracket 12 which is mounted adjacent one end thereof on a slide S (shown fragmentarily in FIGS. 1 and 4) for reciprocation thereby toward and away from a workpiece W (FIG. 1) in a manner noted hereinafter. Bracket 12 has integral with and projecting from its right or closed end as shown in FIG. 2 two, spaced, parallel bracket arms 13 and 14. Between the two arms 13 and 14 thereof, bracket 12 has formed in its outer or open end a large, central opening 15 which is generally U-shaped in cross section. Adjacent their outer ends (or left ends thereof) as shown in FIGS. 1 and 2, the bracket arms 13 and 14 have secured therein opposite ends, respectively, of a pair of spaced, parallel fulcrum pins 17 and 18.

Mounted intermediate their ends on the pins 17 and 18 for limited movement thereabout are two thread roll supporting arms 21 and 22, respectively. In their outer ends (the left ends as shown in FIGS. 1 and 2) the arms 21 and 22 have therein large, arcuate recesses 21' and 22', respectively. Rotatably mounted at opposite ends thereof in registering bores formed in opposite sides, respectively, of the recesses 21' and 22' and extending coaxially thereacross are two carbide roll pins 23 and 24, each of which has a spur gear 25 rotatable thereon adjacent one end thereof. Secured on each of the pins 23 and 24 for rotation coaxially therewith, and in the respective recess 21' and 22', is a conventional threading roll R.

At their ends remote from the threading rolls R, the arms 21 and 22 extend into the recess 15 in bracket 12, and in spaced relation to each other. Mounted for rotation on shafts 26 and 27, which extend across central recesses formed in the inner ends of arms 21 and 22, and parallel to the fulcrum pins 17 and 18, are wedge roller pins 26 and 27, respectively. Rotatably mounted coaxially on the pins 26 and 27 intermediate the ends thereof are cylindrically shaped wedge rollers 28 and 29, respectively. The outer peripheral surfaces of the rollers 28 and 29 have rolling engagement with the opposed, inclined surfaces 31 and 32 formed on the forward end of a wedge 30, the rear end of which extends into a central opening formed in bracket 12 adjacent its closed end to open onto the recess 15. Wedge 30 has therethrough an elongate bore 33 extending between opposite ends thereof, and has rotatably mounted therein adjacent its rear end a pivot pin 34 the axis of which extends normal to bore 33 and parallel to the axes of pins 26 and 27. Also, pivot pin 34 has therethrough an internally threaded bore 35 (FIG. 3) the diameter of which is slightly less than the diameter of the bore 33 in wedge 30, and the axis of which extends normal to the axis of pin 34, but is adjustable by pin 34 into coaxial registry with the wedge bore 33.

Figure 1:
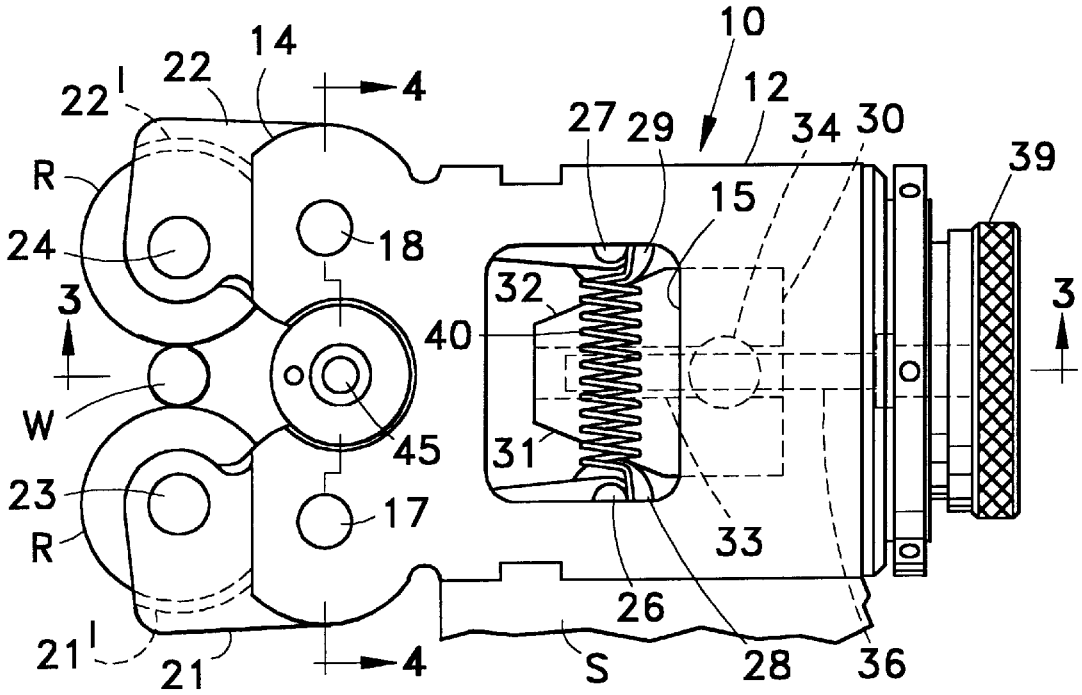
FIG. 1 is a side elevational view of an improved tangential thread rolling head made according to one embodiment of this invention, a portion of the head being broken away and shown in section.
Figure 2:
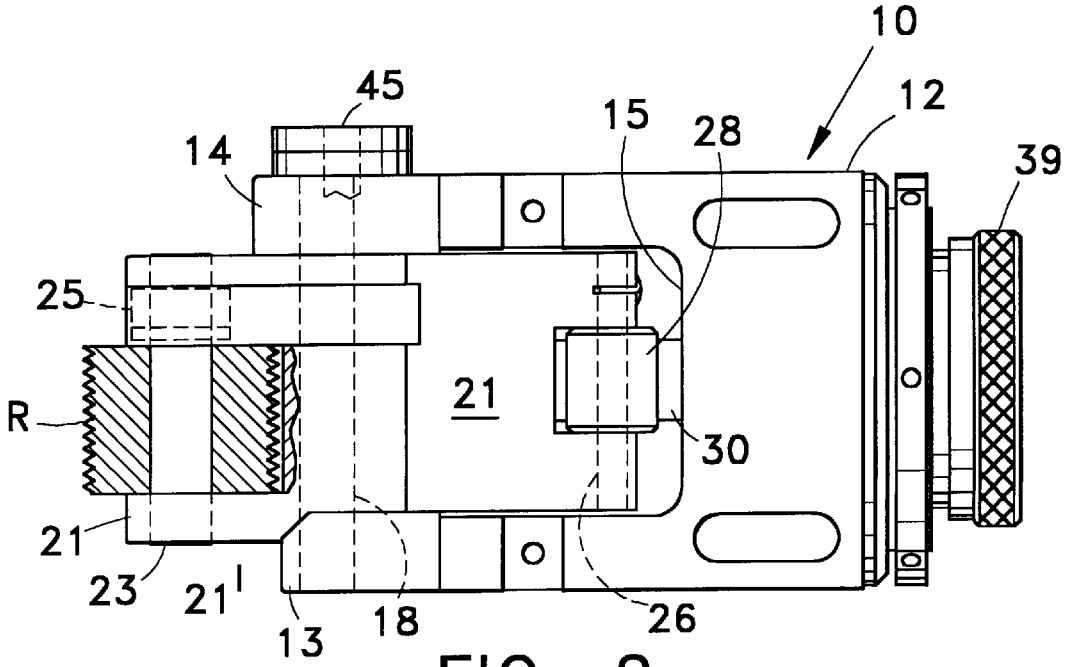
FIG. 2 is a bottom plan view of this thread rolling head with a portion thereof broken away and showing one of the thread rolls in cross section.
Figure 3:
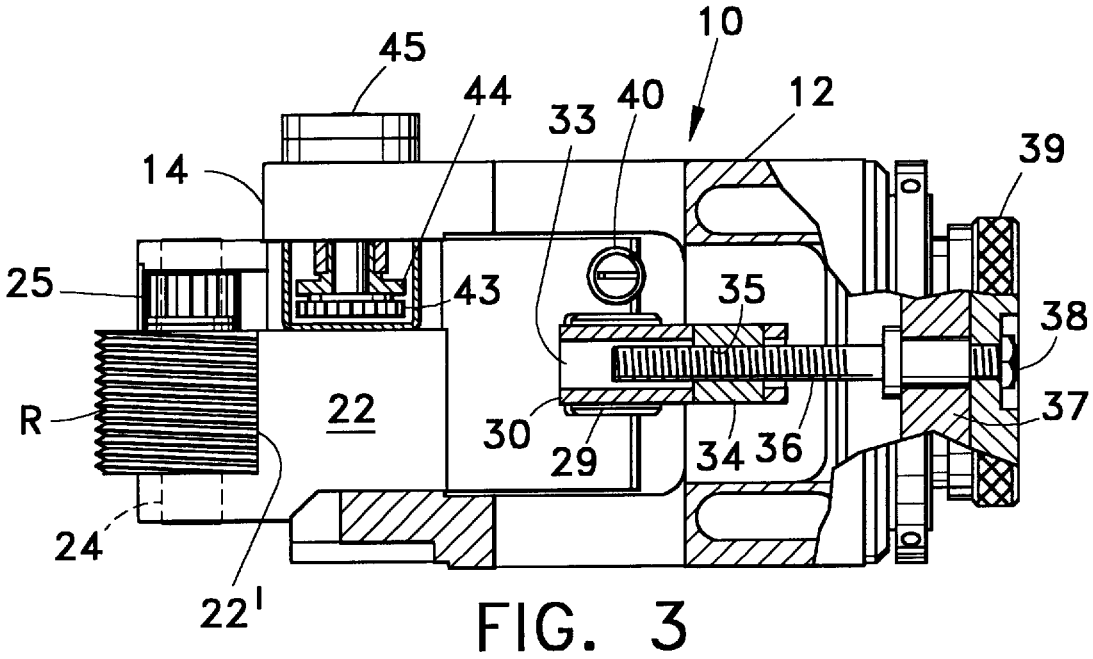
FIG. 3 is a sectional view taken generally along the line 3—3 in FIG. 1 looking in the direction of the arrows, but with portions shown in full.

The wedge 30, via the pin 34, is mounted for reciprocable adjustment in the bracket 12 toward and away from the threading rolls R by means of an externally threaded adjusting screw 36, which threads adjacent one end thereof (the left end as shown in FIGS. 1 and 3) adjustably through the internally threaded bore 35 that extends through the center of the pin 34. Screw 36 is rotatably journaled adjacent its opposite or outer end in an end plate 37 (FIG. 3) which is removably secured over an opening formed in the closed end of bracket 12 to communicate with the central opening containing wedge 30. Screw 36 extends through and slightly beyond the outer end of the end plate 37 and has a reduced-diameter externally threaded end which is secured by a stop nut 38 to the center of a circular adjusting knob 39, which is mounted for rotation on the end plate 37 coaxially thereof.

As shown more clearly in FIG. 1, the roller arms 21 and 22 are connected at their inner ends to opposite ends of one or more tension springs 40, which tend resiliently to maintain the wedge rollers 28 and 29 in rolling engagement with the wedge surfaces 31 and 32. As a consequence, depending upon the direction in which the adjusting knob 39 is rotated, the wedge 30 will be either advanced or retracted relative to rollers R. When the head 10 is being prepared for use, and the wedge 30 is advanced toward the left in FIG. 1, its surfaces 31 and 32 urge the rollers 28 and 29 further apart from each other, thereby in turn causing the threading rolls R at the opposite ends of the arm 21 and 22 to be urged radially toward each other. On the other hand when the adjusting knob 39 is rotated in the opposite direction, the wedge is retracted or is shifted toward the right in FIG. 1, so that its wedging surfaces 31 and 32 are shifted rearwardly in bracket 12, whereby the spring or springs 40 cause the arms 21 and 22 to be swung in clockwise directions around the axes of their respective shafts 17 and 18, and thereby increasing the space separating the threading rolls R.

The spur gears 25, which are rotatably mounted on one end of each of the roll pins 23 and 24, are interconnected to each other by a gear mechanism of the type disclosed in the above-noted U.S. Pat. No. 4,617,816, and which forms no part of the instant invention. For example, in a manner similar to that disclosed in the above patent, the herein disclosed pivot or fulcrum pins 17 and 18 for the arms 21 and 22 have secured thereon idler gears 41 and 42, respectively, which are drivingly connected to the spur gears 25 on the pins 22 and 23, respectively. The teeth of the idler gears 41 and 42 are drivingly engaged with the teeth of external and internal compensator gears 43 and 44, respectively, which are secured to the inner end of a dual gear shaft 45 that is rotatably mounted intermediate its ends in the bracket arm 14 for rotation about an axis extending parallel to and medially spaced between the pivot pins 17 and 18.

In use, a determination is made first of all as to the diameter of the work W which is to be threaded, and the type of threading rolls R that are to be employed. At the outset, while the head 10 has been retracted away from the work W by the slide S, the wedge 30 is adjusted by the knob 39 so that the two rolls R are radially spaced from each other the desired distance. In practice this can be achieved by placing a sample of the work W between the rolls R, and then adjusting the wedge via the knob 39 until the desired spacing between the rolls R has been achieved. Thereafter, when the desired work W has been mounted in the machine chuck, and has been rotated in the intended manner, the slide S is then advanced toward the work, and at a predetermined feed rate based upon the rate at which the work is being rotated about its axis. In this manner rolls R are gradually engaged tangentially with diametrally opposite sides of the work W, and in practice are normally advanced by the slide S to a point in which a plane containing the axes of pins 23 and 24 extends slightly beyond (to the left as shown in FIG. 1) the centerline of the revolving work W. After the peripheral surface of the work W has been threaded by the rolls R, the slide S is retracted (towards the right in FIG. 1) thereby withdrawing the head 10 from engagement with the work W.

From the foregoing it will be apparent that the present invention provides a relatively simple and inexpensive means for very accurately adjusting the space between the threading rolls R prior to the advance thereof by the slide S tangentially into engagement with the work W that is to be threaded. One of the advantages of this construction is that the wedge 30 is mounted for slight pivotal movement about the axis of the pin 34 so as to permit slight, automatic adjustment of the wedge on pin 34 during operation of the rolls R. The bore 33 in the wedge 30 is slightly larger in diameter than the outside diameter of the screw 36, so that the pivotal movement of the wedge 30 about the pin 34 will be limited. In any event, any necessary adjustment of the wedge 30 either toward or away from the rolls R can be very accurately and easily effected simply by manual rotation of the knob 39, and any necessary replacement thereof can be effected by removing the end plate 37.

While this invention has been illustrated and described in detail in connection with only certain embodiments thereof, it will be apparent that it is readily capable of still further modification. For example, although the pins 23 and 24 upon which the threading rolls R are mounted, are shown to be disposed in spaced, parallel relation to each other, it will be apparent that, if desired, this adjusting mechanism can also be employed with thread rolls of the type which are disposed to be mounted on shafts or pins the axes of which are inclined slightly to each other and/or are adjustable selectively to adjust at the inclination of one such axis relative to the other as taught for example in the above-noted U.S. Pat. No. 4,617,816, or in U.S. Pat. No. 5,167,136, which is also owned by the Assignee of the present invention. Moreover it will be apparent that this application is intended to cover any such modifications as may fall within the scope of one skilled in the art, or within the scope of the appended claims.

What is claimed is:

1. In a thread rolling attachment for a machine of the type having a slide reciprocable transversely of a rotating workpiece for selectively engaging a pair of threading rolls on the attachment into tangential rolling engagement with the workpiece, the improvement comprising a generally yoke-shaped bracket secured on said slide for reciprocation thereby to and from said workpiece, said bracket having a closed end and a pair of spaced, parallel arms integral with and projecting outwardly from said closed end toward saidworkpiece, a pair of spaced fulcrum pins extending transversely between said bracket arms and generally parallel to the axis of rotation of the workpiece, a pair of roll arms pivotally mounted intermediate their ends on said pins, each of said roll arms having an inner end facing and spaced from said closed end of the bracket, and an outer end extending beyond the outer ends of said bracket arms, a pair of spaced thread roll rotatably mounted on the outer ends of said roll arms, and a pair of spaced roller followers rotatably mounted on the inner ends of said roll arms, a thread roll adjusting element adjustably mounted between the arms of said bracket adjacent the closed end thereof and having a generally wedge-shaped forward end extending between said roller followers, resilient means urging each of said roll arms in a direction to maintain said roller followers in rolling engagement with opposed, inclined surfaces formed on said wedge-shaped end of said element, and means for adjusting said element including a knob rotatably mounted on said closed end of said bracket and operatively connected to said element, said knob being rotatable manually to shift said element selectively in opposite directions thereby to vary the space separating said followers and consequently the space separating said thread rolls, said adjusting means including a screw secured at one end to said knob for rotation thereby about an axis extending normal to the axes of said fulcrum pins, and having on its opposite end an externally threaded shank portion extending into an opening in said element, and means in said opening supporting said element on said screw for movement axially of said shank portion thereof and for limited pivotal movement relative thereto about an axis normal to the axis of rotation of said screw.

2. In a thread rolling attachment as defined in claim 1, wherein said means supporting said element in said opening is drivingly connected to said threaded shank portion of said screw thereby to cause said element to shift in said opposite directions upon rotation of said knob in opposite directions.

3. In a thread rolling attachment as defined in claim 1, wherein said means supporting said element in said opening comprises a pin extending transversely across said opening and pivotal relative to said element about said axis extending normal to the axis of said screw, and said threaded shank portion of said screw is drivingly connected to an internally threaded bore formed in said pin parallel to the axis of said screw.

4. In a thread rolling attachment as defined in claim 3, wherein said threaded portion of said screw extends through said bore in aid pin and into said opening, and is smaller in diameter than the diameter than the diameter of said opening.

5. A thread roll attachment for rolling threads on a rotating workpiece in a machine, comprising a generally U-shaped bracket having a closed end and a pair of spaced, parallel bracket arms projecting outwardly from the closed end thereof, a pair of roll arms pivotally mounted intermediate their ends on the outer ends of said bracket arms, each of aid roll arms having an inner end extending between said bracket arms, and an outer end extending beyond the outer ends of said bracket arms, a pair of spaced thread rolls rotatably mounted on the outer ends of said roll arms for rotation thereon about a pair of spaced axes extending generally parallel to each other and to the axis of the workpiece that is to be threaded, and means including a movable thread roll adjusting element mounted on said bracket adjacent the closed end thereof and operatively connected to said inner ends of said roll arms to control the pivotal movements thereof, and to control a space separating said thread rolls, said means including an adjusting screw mounted on said bracket for rotation manually and selectively at opposite directions about an axis extending transversely of the axes of rotation of said thread rolls, and said means further including means connecting said screw to said adjusting element and operative upon rotation of the screw in one direction to shift said element in a direction to move said inner ends of the roll arms toward each other, and operative upon rotation of said screw in the opposite direction, to move said inner ends of said roll arms away from each other, said adjusting screw being rotatably journaled adjacent one end thereof in said closed end of said bracket and being secured to an adjusting knob rotatably mounted on the closed end of said bracket and operable manually to rotate said screw selectively in opposite directions, said screw having thereon adjacent its opposite end an externally threaded portion that extends into a bore in one end of said adjusting element, and said means connecting said screw to said adjusting element being drivingly connected in said bore to said externally threaded portion of said screw.

6. A thread roll attachment as defined in claim 5, wherein said means connecting said screw to said adjusting element includes means mounting said adjusting element on said screw for movement axially thereof upon rotation of said screw, and for limited pivotal movement relative to said screw about an axis extending normal to the axis of rotation of said screw.

7. A thread roll attachment as defined in claim 5, wherein the opposite end of said adjusting element extends between said inner ends of said roll arms, and said means connecting said screw to said adjusting element comprises a pin extending transversely of the bore in said adjusting element for limited pivotal movement relative to said element about an axis extending normal to the bore in said element, and said threaded portion of said screw being drivingly connected to a bore formed in said pin parallel to the axis of said screw.

8. A thread roll attachment as defined in claim 7, wherein the diameter of said bore in said adjusting element is greater than the diameter of said threaded portion of said screw, and said bore in said pin extends through said pin at right angles to the pivotal axis of said pin.

* * * * *